US006210138B1

(12) United States Patent
Cortez

(10) Patent No.: US 6,210,138 B1
(45) Date of Patent: Apr. 3, 2001

(54) ROTARY PUMP APPARATUS AND METHOD

(75) Inventor: Phillip V. Cortez, Concord, CA (US)

(73) Assignee: Tuthill Pump Group, a subsidiary of Tuthill Corporation, Concord, CA (US)

( * ) Notice: Subject to any disclaimer, the term of this patent is extended or adjusted under 35 U.S.C. 154(b) by 0 days.

(21) Appl. No.: 09/349,656

(22) Filed: Jul. 8, 1999

(51) Int. Cl.[7] ..... F03C 2/00

(52) U.S. Cl. ..... 418/132; 418/206.1; 418/206.4; 418/1

(58) Field of Search ..... 418/132, 206.1, 418/206.4, 1

(56) References Cited

U.S. PATENT DOCUMENTS

| | | | | |
|---|---|---|---|---|
| 207,862 | * | 9/1878 | Fitts | 418/206.4 |
| 1,348,771 | * | 8/1920 | Auger | 418/206.1 |
| 1,348,772 | * | 8/1920 | Auger | 418/206.1 |
| 3,251,309 | * | 5/1966 | Schmiel et al. | 418/132 |
| 3,363,578 | * | 1/1968 | Sisson | 418/132 |
| 3,371,615 | * | 3/1968 | PettyJohn et al. | 418/132 |
| 3,937,604 | * | 2/1976 | Taylor | 418/132 |
| 4,057,375 | * | 11/1977 | Nachtrieb | 418/206.1 |
| 4,337,018 | * | 6/1982 | Singer et al. | 418/132 |
| 4,355,964 | * | 10/1982 | Rodibaugh et al. | 418/206.1 |
| 4,830,592 | * | 5/1989 | Weidhaas | 418/132 |
| 5,131,829 | * | 7/1992 | Hampton | 418/206.4 |
| 6,042,352 | * | 3/2000 | Halter et al. | 418/132 |

* cited by examiner

*Primary Examiner*—Thomas Denion
*Assistant Examiner*—Theresa Trieu
(74) *Attorney, Agent, or Firm*—Thomas R. Lampe

(57) ABSTRACT

Rotary pump apparatus includes a pump housing having a drive gear and a driven gear positioned in the interior of the housing. A fluid-flow passageway provides fluid to a volumetrically changing space located between meshing gear teeth to prevent the pressure in the space from dropping below the vapor pressure of the fluid.

18 Claims, 4 Drawing Sheets

ROTARY PUMP APPARATUS AND METHOD

TECHNICAL FIELD

This invention relates to rotary pump apparatus incorporating structure for reducing cavitation during pump operation and reducing pump damage caused by cavitation. The invention also encompasses a method.

BACKGROUND OF THE INVENTION

Rotary pumps are well known structures employed to pump fluids from one location to another. Rotary gear pumps conventionally employ two gears having meshing teeth disposed in a rotary pump housing to deliver fluid entering the housing interior from an inlet opening to an outlet opening. One of the toothed gears is a drive gear rotated by a motor or other suitable means while the other gear conventionally is a driven gear driven by and rotating in response to rotation of the drive gear.

It is not at all unusual for cavitation pitting damage to occur in rotary pumps. Typically such damage will be in the form of pitting occurring within the interior of the pump housing. Pump life can be drastically reduced and considerable time and expense can be involved when repairing or replacing pumps having cavitation pitting damage.

DISCLOSURE OF INVENTION

The present invention is directed to a rotary pump apparatus and to a method for reducing cavitation damage.

The rotary pump apparatus of the present invention includes a pump housing defining a housing interior, a fluid inlet opening in communication with the interior and a fluid outlet opening in communication with the interior and spaced from the fluid inlet opening.

A drive gear having drive gear teeth is rotatably mounted relative to the pump housing and located within the housing interior.

A driven gear having gear teeth is rotatably mounted relative to the pump housing and located within the housing interior. The gear teeth of the drive gear mesh with the gear teeth of the driven gear and define therewith a space located between the meshing drive gear teeth and the driven gear teeth varying in volume during rotation of the drive and driven gears.

A fluid-flow passageway extends between the inlet fluid opening and the space for introducing fluid into the space from the fluid inlet opening during increase in volume of the space during rotation of the drive and driven gears to relieve negative fluid pressure within the space during the increase in volume.

The invention further encompasses a method of reducing cavitation in a rotary pump, the pump including a pump housing forming a housing interior and a pair of rotating toothed gears forming a gear mesh located in the housing with the teeth of the gears engaged in the mesh forming a volumetrically variable space during gear rotation.

The method includes the step of establishing a fluid-flow passageway extending to the gear mesh.

Fluid is introduced into the fluid-flow passageway and the method further includes the step of flowing the introduced fluid through the fluid-flow passageway.

The fluid flowing through the fluid-flow passageway is directed into the space during rotation of the gears to relieve negative fluid pressure in the space caused by the rotation.

In the illustrated preferred embodiment, a fluid inlet opening is formed in the pump housing and the fluid-flow passageway is established between the fluid inlet opening and the gear mesh, the fluid flowing into the fluid-flow passageway from the fluid inlet opening.

Other features, advantages, and objects of the present invention will become apparent with reference to the following description and accompanying drawings.

BEST MODE FOR CARRYING OUT THE INVENTION

Figure 1:
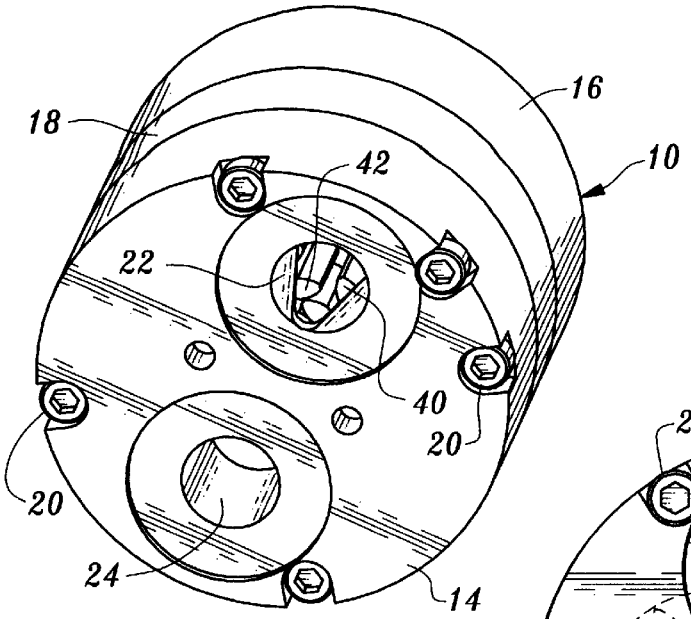
FIG. 1 is a perspective view of rotary pump apparatus constructed in accordance with the teachings of the present invention.
Figure 2:
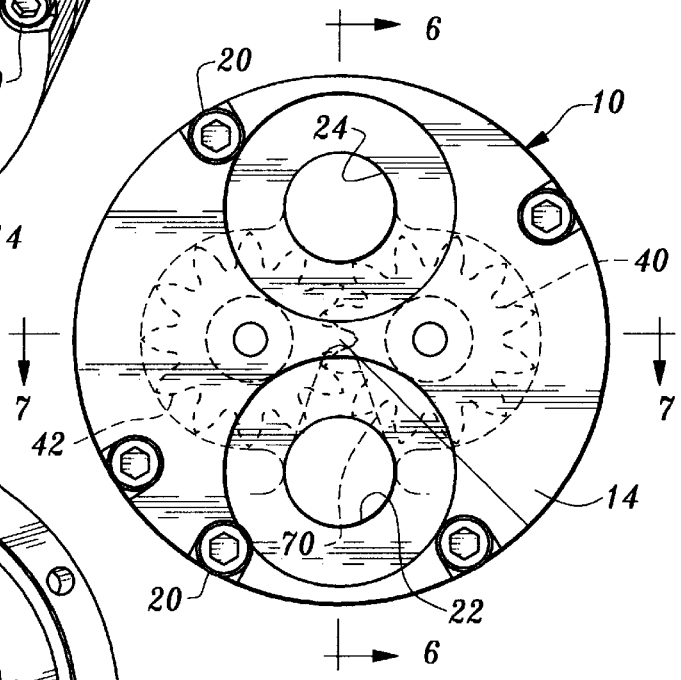
FIG. 2 is an elevational view of the apparatus illustrating the fluid inlet and outlet openings or ports thereof, with interior structural features of the apparatus shown by dash lines.
Figure 3:
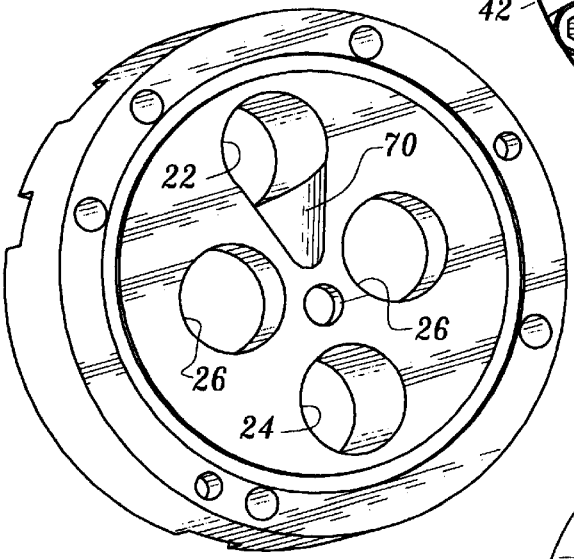
FIG. 3 is a perspective view of a cap incorporated in the pump housing and illustrating an interior wall thereof defining fluid inlet and outlet openings and a fluid-flow passageway in the form of a channel formed in the cap.
Figure 4:
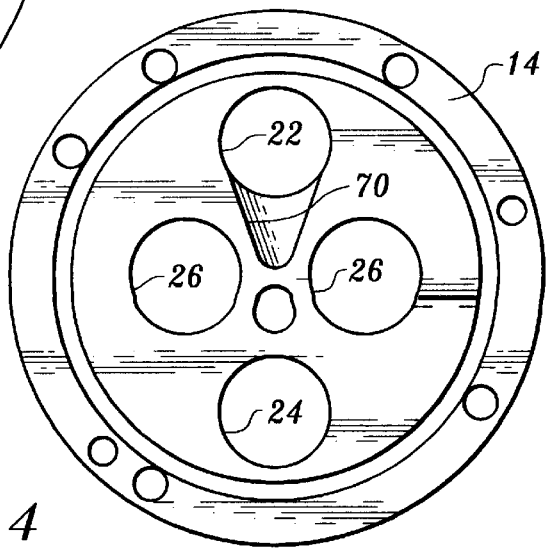
FIG. 4 is an elevational view of the cap as seen from the interior of the housing.
Figure 5:
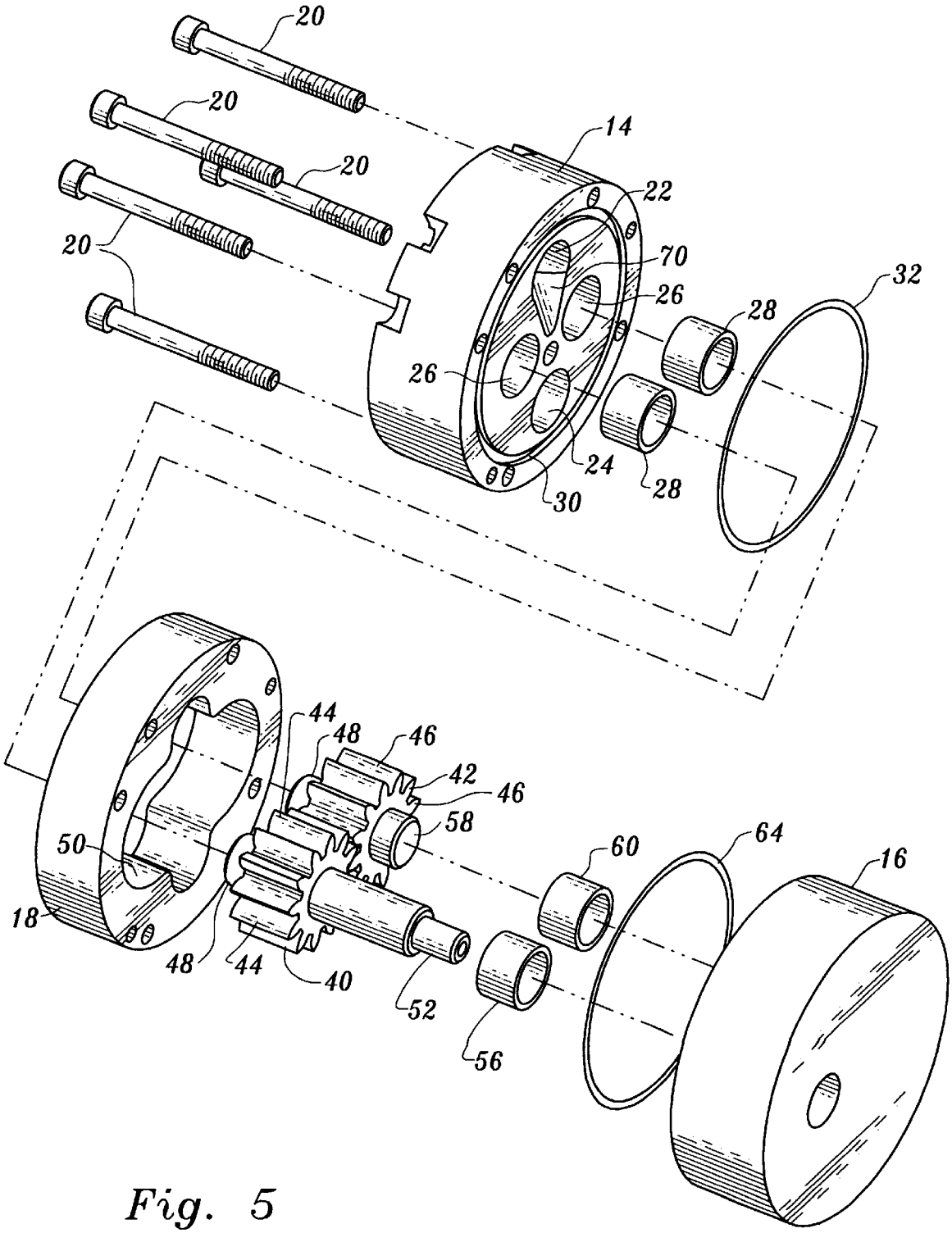
FIG. 5 is an exploded, perspective view illustrating structural components of the rotary pump apparatus prior to assembly thereof.
Figure 6:
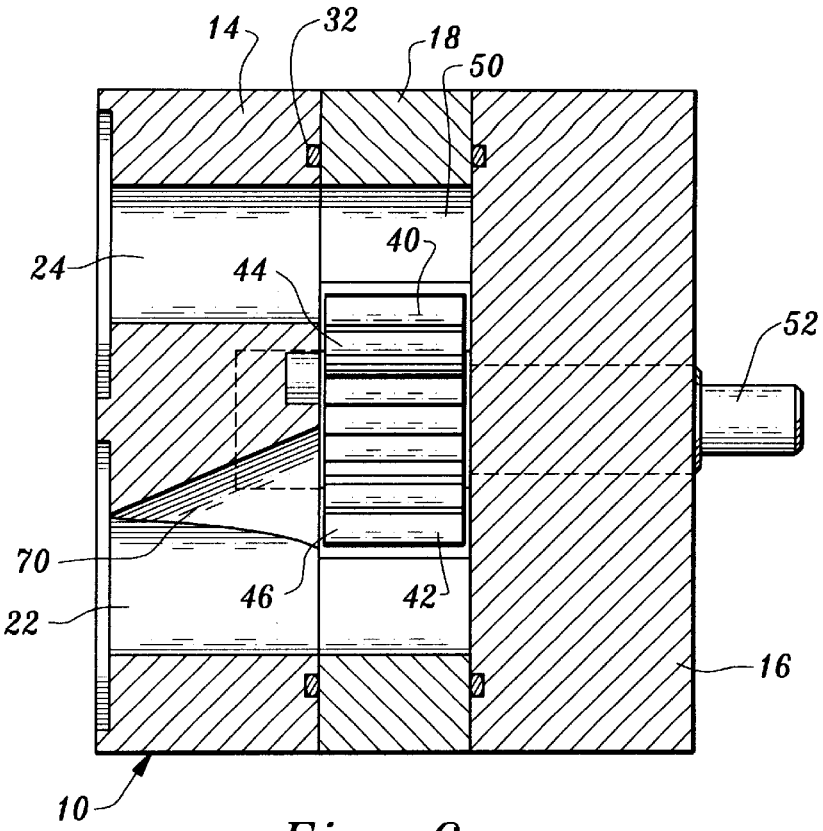
FIG. 6 is an enlarged, partial cross-sectional view taken along the line 6—6 of FIG. 2.
Figure 7:
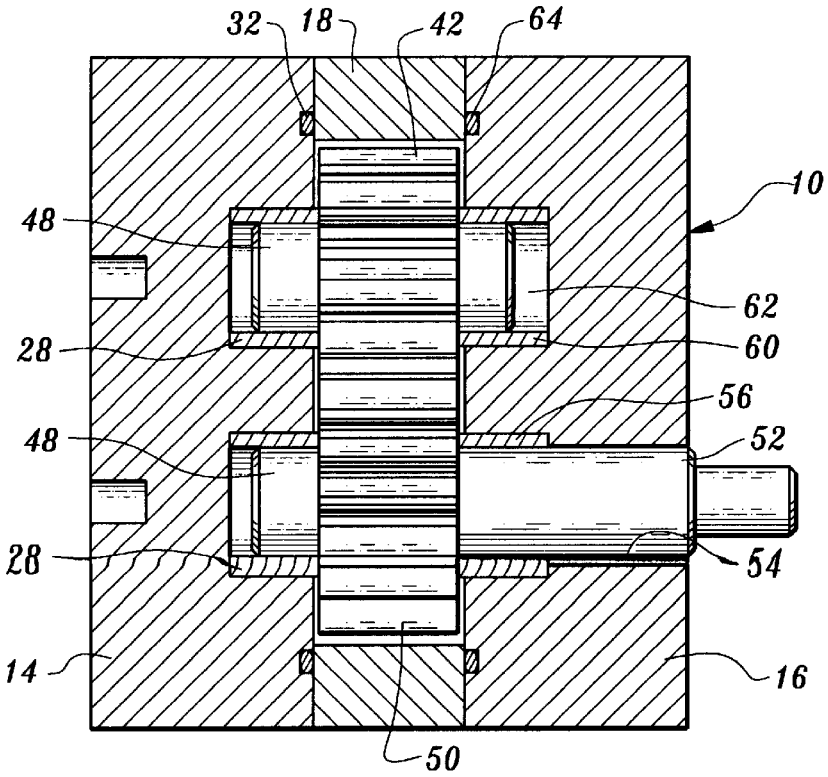
FIG. 7 is an enlarged, cross-sectional view taken along the line 7—7 of FIG. 2.

Referring now to the drawings, rotary pump apparatus constructed in accordance with the teachings of the present invention is illustrated. The apparatus includes a pump housing 10 having a housing interior. In the arrangement illustrated, the pump housing includes a cap 14, a housing body 16 and a housing member 18 having a cylindrical outer surface secured between the cap 14 and housing body 16 by any suitable expedient such as bolts 20 threadedly engaged with housing body 16.

Cap 14 of the pump housing has a fluid inlet opening 22 and a fluid outlet opening 24 formed therein at spaced locations in a conventional manner. The fluid inlet opening is of course connected to a source (not shown) of fluid to be pumped and fluid outlet opening 24 communicates with a downstream fluid flow path (not shown).

Formed in the inner wall of the cap 14 are two recesses 26 which receive bushings 28 therein. A circular groove 30 receives an O-ring seal 32 to provide a fluid-tight seal between cap 14 and housing member 18 when the apparatus is secured together.

Positioned in housing member 18 are a drive gear 40 and a driven gear 42 having gear teeth 44, 46, respectively, disposed thereabout. Stub shafts 48 project from the gears and are rotatably disposed in bushings 28.

The gears 40, 42 are disposed in a cavity 50 formed in housing member 18, the gears closely conforming to the shape of the cavity to deliver fluid from fluid inlet opening 22 to fluid outlet opening 24 in the spaces between the gear teeth and the housing member 18 in a well known manner.

An elongated shaft 52 projects from drive gear 40 through a hole 54 formed in housing body 16, a bushing 56 being employed to rotatably support the shaft 52. Any suitable means such as the output shaft of a motor (not shown) may be employed to rotate shaft 52 and drive gear 40. The intermeshing of the teeth of the drive gear and the driven gear cause driven gear 42 to rotate with the drive gear. A stub shaft 58 projecting from driven gear 42 is rotatably positioned in a bushing 60 residing in a recess 62 of the housing body 16. An O-ring seal 64 maintains the housing body 16 and housing member 18 in fluid-tight relationship.

The illustrated pump housing, drive and driven gears and related structure just described are of a conventional nature and such construction is merely representative of rotary pump structures to which the teachings of the present invention are applicable.

Figure 8:
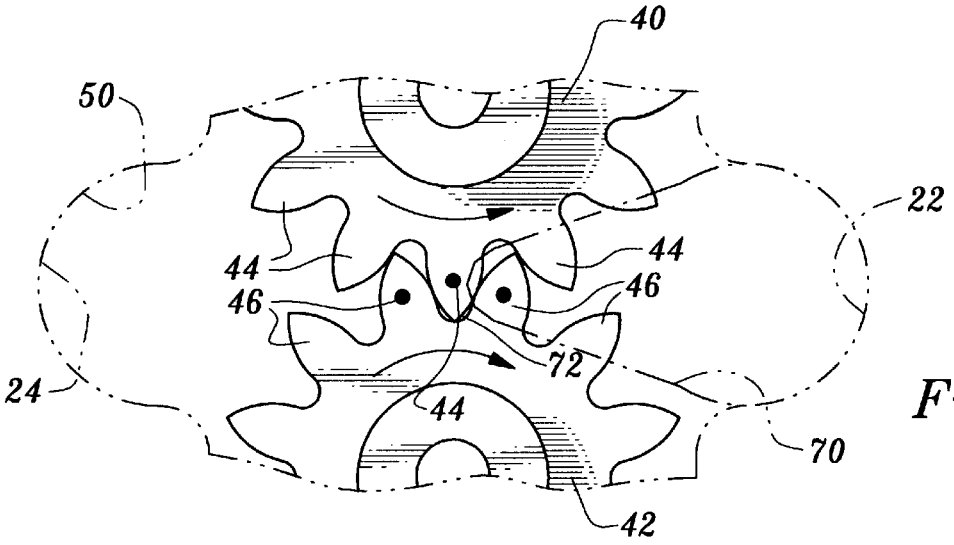
FIGS. 8–10 are somewhat diagrammatic enlarged views of gear mesh teeth of the rotary pump apparatus during sequential stages of operation thereof and their relationship to a fluid-flow passageway formed in the pump housing and extending to the mesh, the location of the fluid-flow passageway being depicted by phantom lines.
Figure 9:
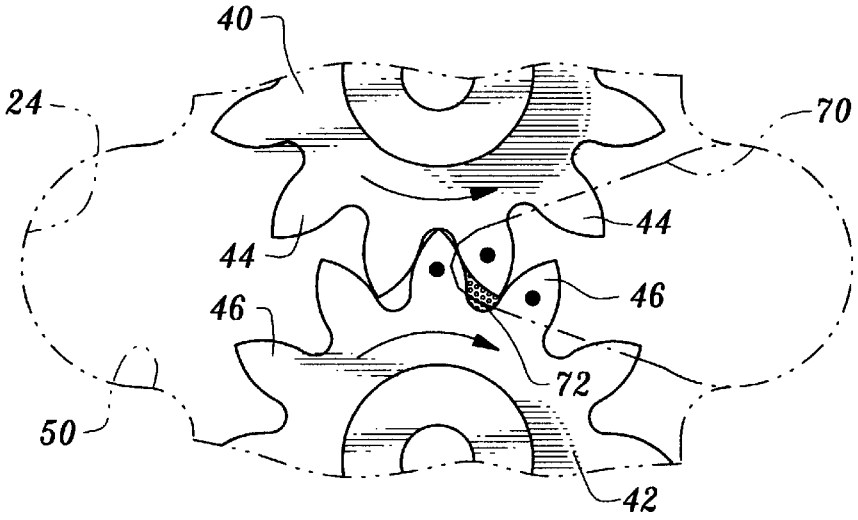
Figure 10:
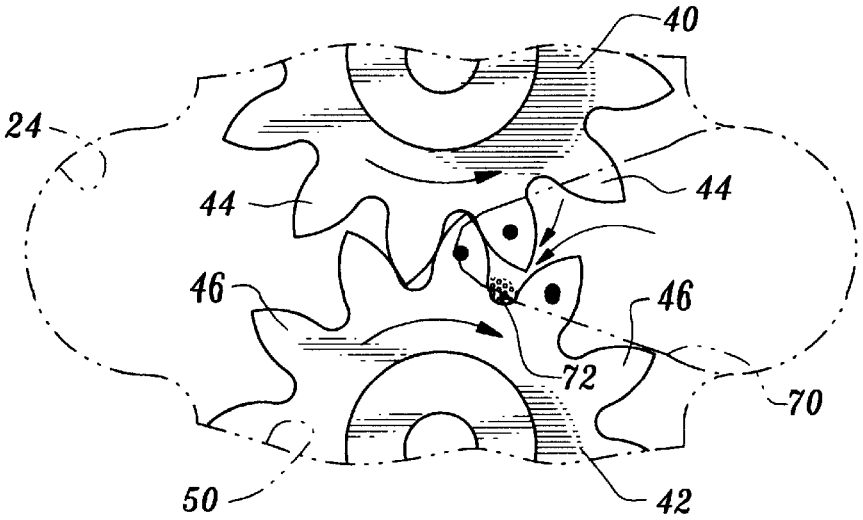

FIGS. 8 through 10 illustrate rotation of drive gear 40 and driven gear 42 during pump operation when pumping fluid from fluid inlet opening 22 to fluid outlet opening 24. The gears rotate in the directions shown by the arrows in these figures. In these figures, two adjacent teeth 46 of driven gear 42 and one tooth 44 of drive gear 40 are designated or marked by dots and one can readily follow the relative movement of the these marked teeth for an illustration of the problems that can occur in conventional rotary pumps that produce pitting or other cavitation caused damage.

It will be noted that in FIG. 8 a tooth 44 is centered between two teeth 46. Fluid is trapped in the space formed by the two marked teeth 46 and the marked tooth 44. This space is designated by reference numeral 72. Further rotation of the gears as shown in FIG. 9 will cause the space to increase volumetrically to a significant degree. That is, an expanding volume is created at the roots of the gear teeth in the mesh. This expansion in volume can cause the fluid pressure in the space to drop below fluid vapor pressure and vapor cavities to be formed in the space. Once the gear mesh opens to the suction fluid these cavities will implode if the suction pressure is high enough. This action results in pitting of the pump components over a period of time. FIG. 10 illustrates the fluid entering the space from outside the mesh. However, in a conventional rotary pump the volume of the space expands faster than the fluid in the pump interior is capable of filling the space.

The above-described problem has been solved by the present invention and the solution is accomplished simply and inexpensively.

More specifically, a fluid-flow passageway in the form of a channel 70 is formed in the pump housing, the channel extending between inlet fluid opening 22 and the volumetrically varying space 72 formed by three meshing teeth of the drive gear and driven gear. This arrangement provides the desired amount of "make-up" fluid in the space as it expands and prevents the formation of vapor cavities in the fluid during expansion of the space. That is, the fluid from channel 70 prevents the pressure in the space from dropping below the vapor pressure of the fluid.

The fluid-flow passageway or channel 70 has a tapered, tear-shaped cross-section diminishing in size in the direction of the space 72 and directs a portion of the fluid passing through the fluid inlet opening to the space. The fluid-flow passageway has a distal end adjacent to the space and the fluid-flow passageway is partially covered by the meshing drive gear teeth and the driven gear teeth. The interior or end wall of the cap 14 is otherwise in substantially fluid-tight relationship with the drive gear and the driven gear, as is the inner wall of housing body 16.

The distal end of the fluid-flow passageway is located at the gear mesh and equi-distant from the axis of rotation of the rotating toothed gears. Thus, the fluid-flow passageway can provide "make-up" fluid to all spaces serially formed at the mesh during rotation of the gears.

What is claimed is:

1. Rotary pump apparatus comprising, in combination:

a pump housing defining a housing interior, a fluid inlet opening in communication with said interior and a fluid outlet opening in communication with said interior and spaced from said fluid inlet opening;

a drive gear having drive gear teeth rotatably mounted relative to said pump housing and located within said housing interior;

a driven gear having driven gear teeth rotatably mounted relative to said pump housing and located within said housing interior, the drive gear teeth meshing with the driven gear teeth at a predetermined location and sequentially defining therewith during rotation of said drive gear and driven gear a plurality of spaces for transporting fluid from said fluid inlet opening to said fluid outlet opening, each space of said plurality of spaces located between said meshing drive gear teeth and said driven gear teeth increasing in volume during rotation of said drive and driven gears to decrease fluid pressure within said space prior to communication being established between said space and said fluid outlet opening; and a fluid-flow passageway at least partially defined by said housing connecting said inlet fluid opening and said space for introducing fluid into said space from said fluid inlet opening during increase in volume of said space during rotation of said drive and driven gears prior to communication being established between said space and said fluid outlet opening to relieve negative fluid pressure within said space during said increase in volume, said fluid-flow passageway extending between said predetermined location and said fluid inlet opening and being sequentially in communication with all the spaces defined by said drive gear and said driven gear at said predetermined location during rotation of said drive and driven gears.

2. The rotary pump apparatus according to claim 1 wherein said housing includes a cap, said fluid-flow passageway formed in said cap.

3. The rotary pump apparatus according to claim 2 wherein said fluid-flow passageway has a tapered cross-section diminishing in size in the direction of said space.

4. The rotary pump apparatus according to claim 1 wherein said fluid-flow passageway has a distal end located at said predetermined location adjacent to said space and partially covered by said meshing drive gear teeth and said driven gear teeth, said distal end being in sequential fluid flow engagement with all the spaces defined by said drive gear teeth and said driven gear teeth.

5. The rotary pump apparatus according to claim 2 wherein said fluid-flow passageway comprises a channel formed in said cap.

6. The rotary pump apparatus according to claim 5 wherein said cap includes an end wall in substantially fluid-tight relationship with said drive gear and said driven gear, said inlet opening and said channel being formed in said end wall.

7. The rotary pump apparatus according to claim 2 wherein said fluid-flow passageway has a tear-shaped cross-section.

8. Rotary pump apparatus comprising, in combination:

a pump housing defining a housing interior and further defining an inlet opening and an outlet opening communicating with said housing interior;

a pair of rotating toothed gears located in said housing interior with the teeth of said gears forming a gear mesh at a predetermined location to sequentially define at said predetermined location during rotation of said toothed gears a plurality of volumetrically expanding spaces, each of said spaces expanding prior to communication thereof with said outlet opening; and a fluid-flow passageway formed in said housing and extending from the outlet opening to said gear mesh in fluid-flow communication with said gear mesh at said predetermined location for introducing fluid into all the spaces defined by said gear mesh during rotation of said gears to sequentially relieve negative fluid pressure in said spaces caused by volumetric expansion thereof during said rotation and prior to fluid flow communication thereof with said outlet opening.

9. The rotary pump apparatus according to claim 8 wherein said fluid-flow passageway comprises a channel formed in said pump housing extending from said inlet opening to said gear mesh.

10. The rotary pump apparatus according to claim 9 wherein said channel is an open channel partially covered by said gear mesh.

11. The rotary pump according to claim 10 wherein said channel has a tapered cross-section diminishing in size in the direction of said gear mesh.

12. The rotary pump according to claim 10 wherein said channel has a distal end located at said gear mesh.

13. The rotary pump according to claim 12 wherein said distal end is located substantially equi-distant from the axes of rotation of said rotating toothed gears.

14. A method of reducing cavitation in a rotary pump including a pump housing defining a housing interior and a pair of rotating toothed gears forming a gear mesh located in said housing at a predetermined location with the teeth of said gears engaged in said mesh sequentially forming volumetrically variable spaces during gear rotation, said method comprising the steps of:

establishing a fluid-flow passageway extending to said gear mesh at said predetermined location;

introducing fluid into said fluid-flow passageway;

flowing the introduced fluid through said fluid-flow passageway; and directing the fluid flowing through said fluid-flow passageway sequentially into each of all the spaces formed during rotation of said gears at said predetermined location while the volume of the space into which the fluid flows is expanding to create a decrease of fluid pressure in the space and while said space is not in communication with a fluid outlet opening of the rotary pump to relieve negative fluid pressure in said space caused by said rotation.

15. The method according to claim 14 wherein a fluid inlet opening is formed in said pump housing and wherein said fluid-flow passageway is established between said fluid inlet opening and said gear mesh, said fluid flowing into said fluid-flow passageway from said fluid inlet opening.

16. The method according to claim 15 wherein the fluid flowing into said fluid-flow passageway comprises a portion of the fluid introduced into said housing interior through said fluid inlet opening.

17. The method according to claim 14 wherein rotation of each gears results in said space having a minimum volume when the gear teeth defining said space have a predetermined relative orientation with a tooth of one gear centered between and engaging two adjacent teeth of the other gear, said fluid from said fluid-flow passageway being directed into said space when the volume of said space increases from said minimum volume during continued rotation of said gear teeth.

18. The method according to claim 14 wherein said fluid entering said space from said fluid-flow passageway is drawn into said space by negative fluid pressure in said space and prevents the pressure in said space from dropping below the vapor pressure of said fluid.

* * * * *